US008744725B2

(12) United States Patent
Troberg et al.

(10) Patent No.: US 8,744,725 B2
(45) Date of Patent: Jun. 3, 2014

(54) PRESSURE CONTROL IN THE COMMON RAIL SYSTEM OF A COMBUSTION ENGINE

(75) Inventors: Tom Troberg, Vasa (FI); Tom Kaas, Solf (FI)

(73) Assignee: Wartsila Finland Oy, Vaasa (FI)

( * ) Notice: Subject to any disclaimer, the term of this patent is extended or adjusted under 35 U.S.C. 154(b) by 324 days.

(21) Appl. No.: 13/141,909

(22) PCT Filed: Dec. 15, 2009

(86) PCT No.: PCT/FI2009/005100

§ 371 (c)(1), (2), (4) Date: Jun. 23, 2011

(87) PCT Pub. No.: WO2010/076380

PCT Pub. Date: Jul. 8, 2010

(65) Prior Publication Data

US 2011/0257868 A1 Oct. 20, 2011

(30) Foreign Application Priority Data

Dec. 31, 2008 (FI) ..... 20086255

(51) Int. Cl.
*F02D 41/00* (2006.01)

(52) U.S. Cl.
USPC ..... 701/103; 123/456

(58) Field of Classification Search
USPC ..... 701/103–105, 114; 123/435, 456, 457, 123/463, 465, 515
See application file for complete search history.

(56) References Cited

U.S. PATENT DOCUMENTS

| | | | | |
|---|---|---|---|---|
| 4,669,436 | A | 6/1987 | Nanjyo | |
| 4,841,936 | A * | 6/1989 | Takahashi | 123/447 |
| 5,553,589 | A | 9/1996 | Middleton | |
| 5,941,210 | A * | 8/1999 | Hill et al. | 123/305 |
| 6,289,873 | B1 | 9/2001 | Dunsworth | |
| 6,581,574 | B1 * | 6/2003 | Moran et al. | 123/497 |
| 2007/0044763 | A1 * | 3/2007 | Ohshima | 123/458 |
| 2009/0084348 | A1 * | 4/2009 | Batenburg et al. | 123/294 |
| 2010/0132668 | A1 * | 6/2010 | Borchsenius et al. | 123/447 |
| 2012/0004822 | A1 * | 1/2012 | Siedentopf et al. | 701/103 |
| 2012/0080010 | A1 * | 4/2012 | Nistler et al. | 123/456 |

FOREIGN PATENT DOCUMENTS

| | | |
|---|---|---|
| EP | 2 165 065 A | 4/1986 |
| EP | 1 647 695 A2 | 4/2006 |
| EP | 1 686 250 A2 | 8/2006 |
| WO | WO-95/23921 | 9/1995 |

* cited by examiner

*Primary Examiner* — Stephen K. Cronin
*Assistant Examiner* — Johnny H Hoang
(74) *Attorney, Agent, or Firm* — Muncy, Geissler, Olds & Lowe, P.C.

(57) ABSTRACT

The apparatus and method according to the invention comprise a controller (7) to form a control signal, which controller is arranged to receive pressure data on the CR system, and into which controller pressure reference data is set. In addition, the apparatus also comprises a module (9) to form an internal pressure reference value to replace the set pressure reference value when forming the control signal.

6 Claims, 3 Drawing Sheets

PRESSURE CONTROL IN THE COMMON RAIL SYSTEM OF A COMBUSTION ENGINE

TECHNICAL FIELD

The present invention relates to pressure control in the CR system of a combustion engine. The invention also relates to pilot fuel feed systems in combustion engines utilising gas, i.e. in gas power engines, in which a CR system is applied. A CR system refers to a Common Rail, i.e. to a common rail fuel injection system. In a CR system, the fuel is brought to a desired pressure level and the pressurised fuel is fed to the nozzles of the engine cylinders. The system has pressure accumulation capacity.

PRIOR ART

FIG. 1 shows an example of a known method of controlling the pressure in a CR system 1. In this example, pressure is measured in the injection system at two points, but there may be only one or several measuring point/-s as well. Pressure is measured by means of pressure sensors 2, the measuring data from which is transmitted to a main control module 3. The main control module forwards the pressure data to cylinder control modules 4 that provide cylinder specific/cylinder group specific controls for the cylinders for adjusting the fuel flow to the cylinders, and control the fuel feed to the CR system. The fuel feed is controlled in control units, for instance in control valves 5. In this manner, the fuel flow rate is approximately the same through every control unit.

FIG. 2 shows a situation, in which a failure has occurred in the main control module 3 or in the communication between the main control module 3 and the cylinder control modules 4. In this case, no information on the pressure of the CR system can be transmitted to the cylinder control modules. If the pressure data was transmitted directly to each cylinder control module, preferably from the closest pressure sensor 6 of the CR system, the problem would be the fact that it cannot be ensured that each control unit receives an approximately same amount of fuel. The cylinder control modules 4 use different pressure references, and even if the pressure sensor data were the same, the cylinder control modules are independent and do not communicate with one another. The pressure control in a CR system is not stable, since the pressure measuring data may be unequal for various control units. This is due to, e.g., the differences between the pressure sensors, pressure waves in the CR system as well as to non-synchronised cylinder control modules. Eventually, the feed devices 5 supply various flow rates to the CR system. Some feed devices 5 are completely open, i.e. they supply a maximum flow rate. Other feed devices are closed, i.e. they do not allow any fuel to flow through. Since the control is not stable, the operating life of the control units is shortened and that may eventually result in the shut-down of the engine.

BRIEF DESCRIPTION OF THE INVENTION

A purpose of the invention is to provide a method and an apparatus for eliminating or at least decreasing the disadvantages of the above-mentioned problem. The purpose is reached by a method according to claim 1 and an apparatus according to claim 6.

The method according to the invention of controlling the pressure in a CR system of a combustion engine comprises the steps of measuring the pressure in the CR system, forming an internal pressure reference value by utilising control signal data for using in place of a set pressure reference value when forming the control signal, and forming a control signal as a response to the measuring and to the internal and set pressure reference value.

The step of forming the internal pressure reference value comprises an operation to reduce the impact of the set reference value on the internal pressure reference value by subtracting a certain portion from the set reference value, which portion is with certain criteria dependent on the value of the control signal.

The apparatus according to the invention comprises a controller to form a control signal, which controller is arranged to receive pressure data on the CR system, and into which controller pressure reference data is set. Further, the apparatus comprises a module to form an internal pressure reference value for using in place of the set pressure reference value when forming the control signal, which module is arranged to utilise the set pressure reference value and the control signal data to form the internal pressure reference value.

The module comprises a sub-module to reduce the impact of the set reference value on the internal pressure reference value. The sub-module is arranged to subtract a portion from the set reference value, which portion is with certain criteria dependent on the value of the control signal. A compensation algorithm, for instance, may be used as a criterion.

LIST OF FIGURES

In the following, the invention is explained more in detail with reference to the figures of the appended drawings.

FIG. 1 shows an example of a known arrangement to control the pressure in a CR system, FIG. 2 shows an example of a failure in the pressure control system of a CR system, FIG. 3 shows an example of the pressure control system in a CR system according to the invention, FIG. 4 shows an example of reducing the impact of a set reference value according to the invention, FIG. 5 shows an example of the method according to the invention.

Figure 1:
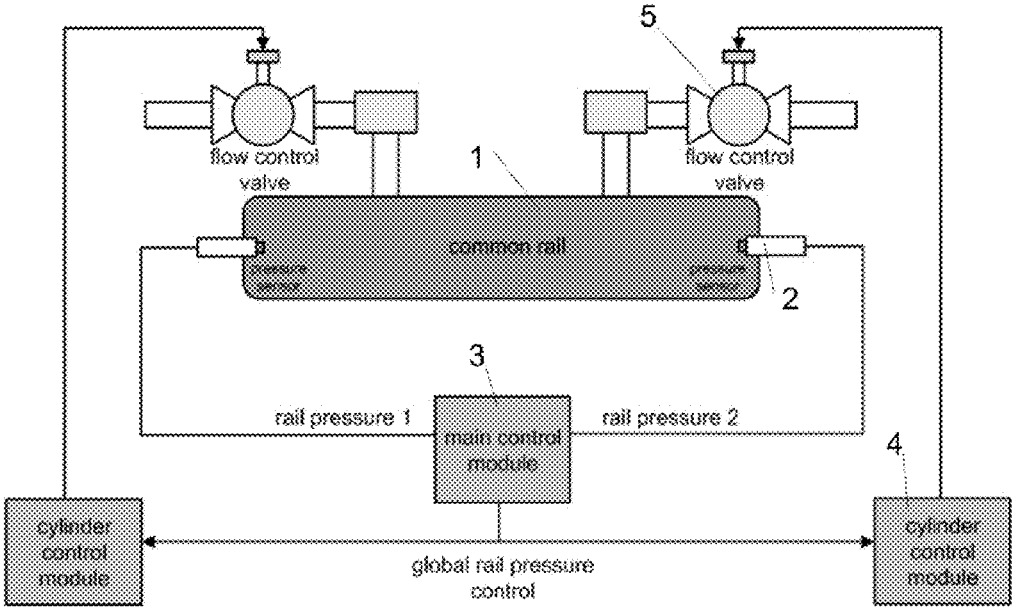
Figure 2:
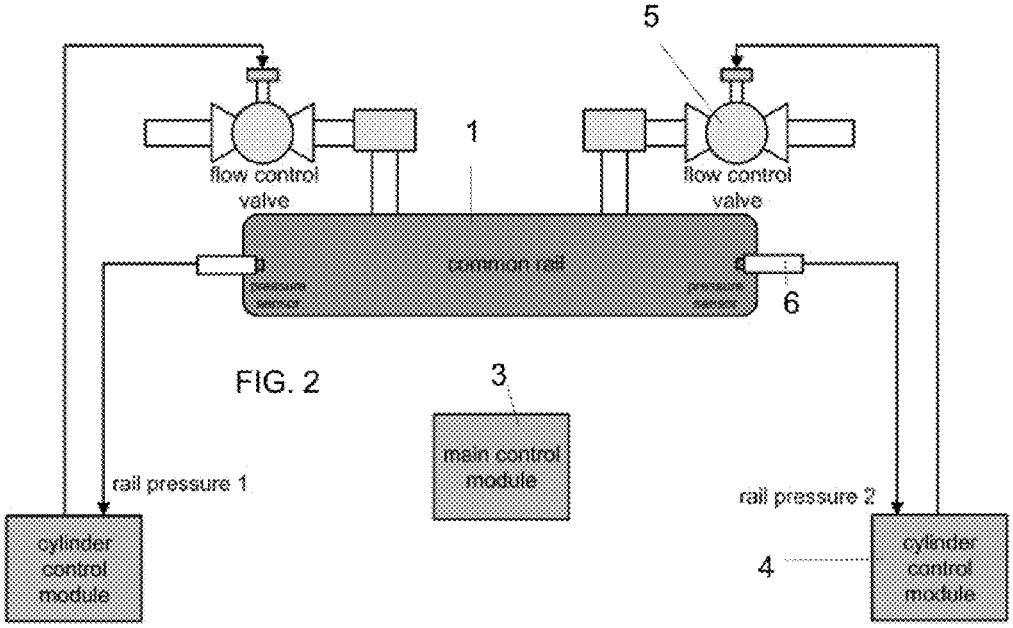
Figure 3:
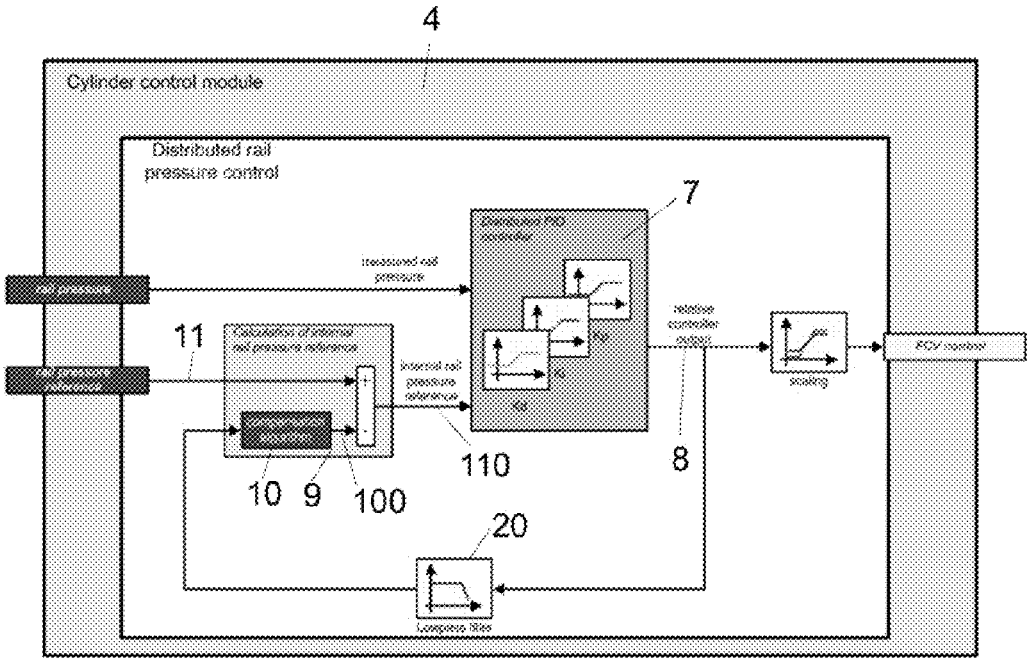
FIG. 3 shows an example of the solution according to the invention, in which a cylinder control module 4 of a combustion engine is provided with an operation, by which the impact of a set reference value 11 on the control signal can be reduced. As previously known, the cylinder control module is provided with a controller 7 that forms a control signal as a response to the pressure measuring data and the set pressure reference. The controller output 8 is transmitted to devices 5 (FIG. 2) that are subordinated to the cylinder control module, such as to flow valves.

The impact of the set reference value can be reduced by subtracting a certain portion 100 therefrom. The residual portion forms an internal reference value, which is used by the controller instead of the set reference value. The portion to be subtracted is provided by utilising the present control signal data. The controller output 8 may be filtered in a lowpass filter 20 before being utilised.

According to one embodiment, the cylinder control module 4 comprises a sub-module 9, which comprises a sub-module 10 to reduce the impact of the set reference value on the internal pressure reference value 110. The sub-module 10 is arranged to subtract a certain portion from the set reference value, which portion is with certain criteria dependent on the value of the control signal.

Said modules can be realised by programming or, e.g., by an ASIC card (Application Specific Integrated Circuit) or by utilising some other appropriate technical realisation. The modules may also be, physically or in terms of programming, a part of one larger integrated unit.

Figure 4:
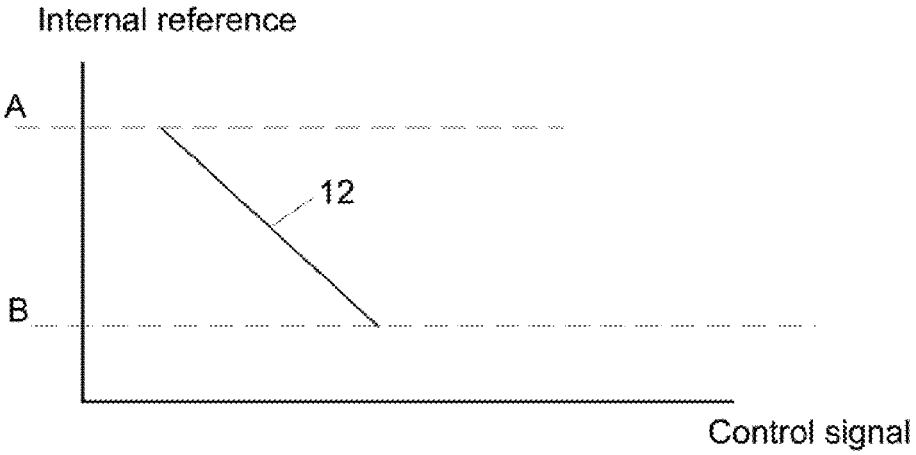

FIG. 4 shows an example of the use of an internal reference value. Level A corresponds to 0% of the possible value of the control signal. Curve 12 illustrates an internal reference value. Once the value of the control signal starts increasing in the direction of the x-axis, the internal reference value is decreased. Level B illustrates 100% of the possible value of the control signal.

In practise, it is possible to arrange the portion to be subtracted from the set reference value so that it is formed by multiplying together the set pressure reference value, the control signal value and a certain coefficient. The coefficient may be formed by utilising integers as well as by multiplication and division operations.

Figure 5:
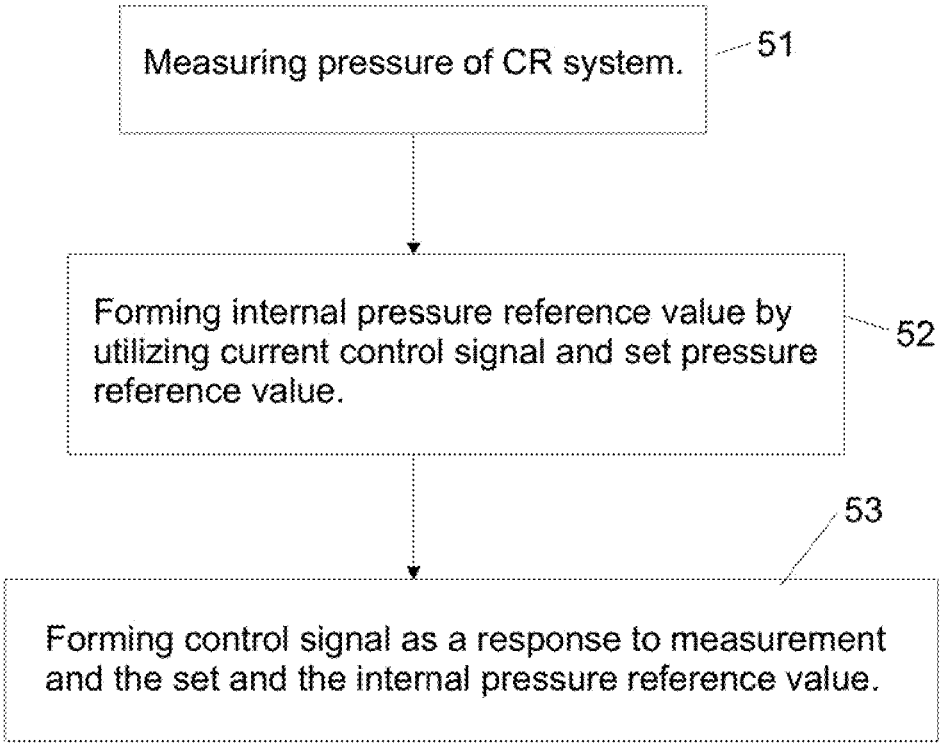

FIG. 5 shows an example of the method.

The method comprises the steps of measuring 51 the pressure of the combustion engine, forming 52 an internal pressure reference value by utilising control signal data for using in place of a set pressure reference value when forming a control signal, and forming 53 the control signal as a response to the measuring and to the internal and set pressure reference value.

On the basis of the above, the method makes it possible to use an internal reference value instead of the set reference value in the controller section 7.

The step of forming the internal pressure reference value comprises an operation to reduce the impact of the set reference value on the internal pressure reference value by subtracting a certain portion from the set reference value, which portion is with certain criteria dependent on the value of the control signal (see FIG. 4). The portion to be subtracted can be arranged to be formed by multiplying together the set pressure reference value, the control signal value and a certain coefficient. The coefficient can be arranged to be formed by utilising integers as well as by multiplication and division operations.

As it appears from the above, an inventive embodiment can be provided by means of several different solutions. Thus, it is clear that the invention is not limited to the examples disclosed in this text only.

Any embodiment according to the invention is thus feasible within the frame of the inventive idea.

The invention claimed is:

1. A method of controlling pressure of a CR system of a combustion engine, which method comprises the steps of measuring the pressure of the CR system and forming a control signal as a response to the measuring and to a set pressure reference value, wherein the method also comprises a step of forming an internal pressure reference value by utilizing the control signal for using when forming the control signal, which step of forming the internal pressure reference value comprises an operation to subtract a certain portion from the set pressure reference value, which portion is dependent on the value of the control signal, the portion to be subtracted is arranged to be formed by multiplying together the set pressure reference value, the control signal value and a certain coefficient.

2. An apparatus for controlling pressure of a CR system of a combustion engine, which apparatus comprises a controller to form a control signal, which controller is arranged to receive pressure data on the CR system, and into which controller pressure reference valued is set, wherein the apparatus further comprises a module to form an internal pressure reference value for using when forming the control signal, which module is arranged to utilize the pressure reference value and the control signal to form the internal pressure reference value, which module comprises a sub-module that is arranged to subtract a certain portion from the pressure reference value, which portion is dependent on the value of the control signal, the portion to be subtracted is arranged to be formed by multiplying together the pressure reference value, the control signal value and a certain coefficient.

3. The apparatus according to claim 2, wherein the apparatus is a cylinder control module.

4. The apparatus according to claim 3, wherein the control signal is arranged to be processed in a lowpass filter before being used in the module.

5. The apparatus according to claim 2, wherein the apparatus is a cylinder control module.

6. The apparatus according to claim 5, wherein the control signal is arranged to be processed in a lowpass filter before being used in the module.

* * * * *